United States Patent [19]

Watanabe et al.

[11] Patent Number: 4,668,843

[45] Date of Patent: May 26, 1987

[54] KEYBOARD SWITCH APPARATUS FOR ELECTRONIC MUSICAL INSTRUMENT

[75] Inventors: Keisuke Watanabe; Toshiyuki Iwamoto, both of Shizuoka, Japan

[73] Assignee: Nippon Gakki Seizo Kabushiki Kaisha, Hamamatsu, Japan

[21] Appl. No.: 828,292

[22] Filed: Feb. 11, 1986

[30] Foreign Application Priority Data

Feb. 12, 1985 [JP] Japan ..... 60-17043[U]
Feb. 12, 1985 [JP] Japan ..... 60-17044[U]

[51] Int. Cl.[4] ..... G10H 3/00

[52] U.S. Cl. ..... 200/5 A; 84/DIG. 7; 200/1 B; 200/159 B

[58] Field of Search ..... 200/5 R, 5 A, 159 B, 200/175, 340, 1 B; 84/1.1, DIG. 7, 1, 423 R, 423 A

[56] References Cited

U.S. PATENT DOCUMENTS

| | | | |
|---|---|---|---|
| 2,942,069 | 6/1960 | Hutton et al. | 200/175 |
| 3,911,233 | 10/1975 | Nakamura et al. | 200/159 B X |
| 4,045,636 | 8/1977 | Yoder et al. | 200/159 B X |
| 4,052,581 | 10/1977 | Matsui et al. | 200/283 |
| 4,272,657 | 6/1981 | Iijima | 84/DIG. 7 |
| 4,301,704 | 11/1981 | Nagai et al. | 84/1.22 |
| 4,376,238 | 3/1983 | Martin | 200/159 B |
| 4,376,879 | 3/1983 | Nagata et al. | 200/159 B X |
| 4,409,450 | 10/1983 | Blades | 200/159 B |
| 4,531,033 | 7/1985 | Schmid et al. | 200/159 B X |

FOREIGN PATENT DOCUMENTS 2100517A 12/1982 United Kingdom ..... 200/159 B

OTHER PUBLICATIONS

Japanese Laid Open Patent Specification No. sho 53-116141, 10-11-1978.

Japanese Laid Open Patent Specification No. sho 59-142600, 8-15-1984.

*Primary Examiner*—J. R. Scott

*Attorney, Agent, or Firm*—Blakely, Sokoloff, Taylor & Zafman

[57] ABSTRACT

A keyboard switch apparatus for an electronic musical instrument has first and second switches each constituted by stationary and movable contacts. The stationary contacts of the first and second switches are formed adjacent to each other on a single board. The movable contacts of the first and second switches are mounted on a single flexible member arranged above the single board and are normally spaced apart from the stationary contacts at positions opposite thereto. The flexible member and the movable contacts of the first and second switches are integrally formed to have a uniform cross-sectional shape along one direction. The flexible member is deformed in response to the depression of a key. The stationary contacts corresponding to the movable contacts of the first and second switches are closed with a time difference according to a speed of key depression.

14 Claims, 14 Drawing Figures

KEYBOARD SWITCH APPARATUS FOR ELECTRONIC MUSICAL INSTRUMENT

BACKGROUND OF THE INVENTION

The present invention relates to a keyboard switch apparatus for an electronic musical instrument and, more particularly, to a keyboard switch apparatus for an electronic musical instrument in which upon depression of a key two switches are closed at different timings according to the key depression speed or force so that by detecting the time difference between the timings the volume, envelope and/or tone color of a musical tone can be controlled, which is often called as touch response control.

Various types of conventional keyboard switch apparatuses of this type to be used in electronic musical instruments have been proposed. These conventional keyboard switch apparatuses have both advantages and disadvantages and can be exemplified by a switch apparatus having a dome-like flexible member made of rubber or the like and a movable contact formed therein, as described in Japanese Patent Prepublication Nos. 53-116141 and 59-142600.

In a conventional keyboard switch apparatus with the structure described above, the flexible member is manufactured by injection molding. Mold preparation cost is high, which leads to high costs for keyboard switch apparatuses. When keyboard switch apparatuses are manufactured in mass production lines, sizes of the switch apparatuses may be different for each mold, thus presenting the problem of dimensional precision. Furthermore, it is difficult to prepare profiles with undercut portions in such a conventional injection-molded switch structure. In this sense, the shape of the switch apparatus is limited. Since these switch apparatuses are designed as single discrete devices, they require the structure of a switch as well as the complete structure of a single discrete device.

SUMMARY OF THE INVENTION

It is, therefore, a principal object of the present invention to provide a keyboard switch apparatus for touch response control in an electronic musical instrument which can be simply manufactured at low cost.

It is another object of the present invention to provide keyboard switch apparatus for an electronic musical instrument wherein uniform characteristics can be obtained with respect to switches for plural keys.

It is still another object of the present invention to provide a keyboard switch apparatus for an electronic musical instrument wherein sizes (contact areas) of movable and stationary contacts can be set with less limitation.

It is still another object of the present invention to provide a keyboard switch apparatus for an electronic musical instrument which has a good space factor along the lateral direction thereof.

It is still another object of the present invention to provide a keyboard switch apparatus for an electronic musical instrument wherein a large number of switches can be arranged in a line.

It is still another object of the present invention to provide a keyboard switch apparatus for an electronic musical instrument wherein a large number of switches can be constituted by a small number of components.

It is still another object of the present invention to provide a keyboard switch apparatus for an electronic musical instrument which provides good key touch.

In order to achieve the above objects of the present invention, there is provided a keyboard switch apparatus for an electronic musical instrument, comprising first and second switches each constituted by stationary and movable contacts, the stationary contacts of the first and second switches being formed adjacent to each other on a substrate, the movable contacts of the first and second switches being mounted on a single flexible member arranged above the substrate and being normally spaced apart from the stationary contacts at positions opposite thereto, the flexible member and the movable contacts of the first and second switches being integrally formed to have a uniform cross-sectional shape along one direction, the flexible member being deformed in response to depression of a key, and the stationary contacts corresponding to the movable contacts of the first and second switches being closed with a time difference according to a speed of the key depression.

DESCRIPTION OF THE PREFERRED EMBODIMENTS

Figure 1:
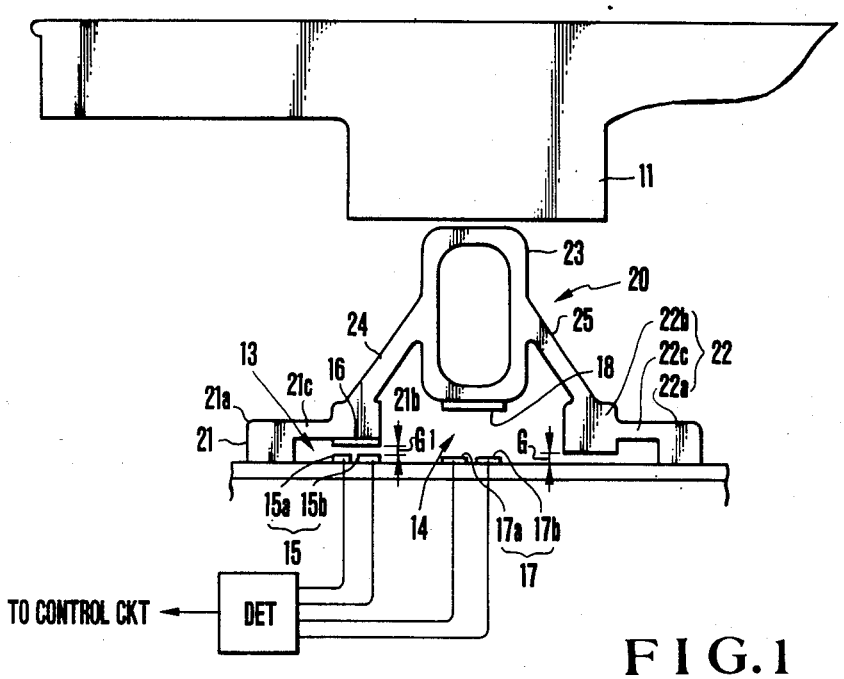
FIG. 1 is a front view of a keyboard switch apparatus according to an embodiment of the present invention.
Figure 2:
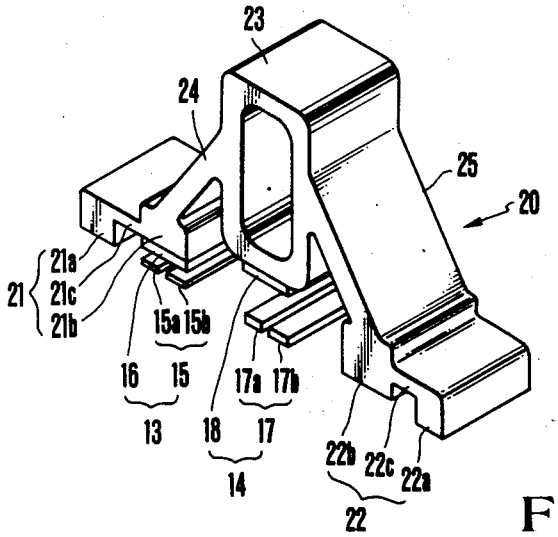
FIG. 2 is a perspective view of a flexible member.

FIGS. 1 and 2 show a keyboard switch apparatus for an electronic musical instrument according to an embodiment of the present invention. Referring to FIGS. 1 and 2, first and second switches 13 and 14 are arranged between a printed circuit board 12 and a key 11. Upon depression of the key 11, the switches 13 and 14 are sequentially closed with a time difference according to the key depression speed. The first switch 13 comprises: a first stationary contact 15 consisting of a pair of conductive films 15*a* and 15*b* formed on the printed circuit board or substrate 12 and located adjacent to each other; and a first movable contact 16 formed above the stationary contact 15 adjacent thereto by a flexible member 20 (to be described later). Similarly, the second switch 14 comprises: a second stationary contact 17 consisting of a pair of conductive films 17*a* and 17*b* formed on the printed circuit board 12 and located adjacent to each other; and a second movable contact 18 which is located above the second stationary contact 17 by the flexible member 20 and which is higher than the first movable contact 16.

The flexible member 20 is prepared by an extrusion forming method such that resin is used as billets and is heated and melted, the melted billets are extruded by a pressure plate through an extrusion port of a die to obtain a rod-like profile with a uniform cross-sectional shape, and the profile is cut into pieces of a predetermined length as required. The flexible member 20 is constituted by a pair of left and right legs 21 and 22 as hook-like or L-shaped members opposite to each other, a longitudinal prism-like main body 23, and a pair of left and right support portions 24 and 25 which elastically and deformably connect the legs 21 and 22 to the main body 23. The legs 21 and 22 comprise base blocks 21*a* and 22*a* of relatively large thickness and width, free end blocks 21*b* and 22*b* having substantially the same size as the base blocks 21*a* and 22*a* and located inside thereof, and plate-like arms 21*c* and 22*c* substantially horizontally extending from the inner sides of the upper ends of the base blocks 21*a* and 22*a* to support the free end blocks 21*b* and 22*b*, respectively. The free end blocks 21*b* and 22*b* normally float above the printed circuit board 12. The left free block 21*b* is located above the first stationary contact 15 and is separated therefrom by a small gap. The first movable contact 16 is formed on the lower surface of the free end block 21*b*. A gap G between the lower surface of the free end block 22*b* and the printed circuit board 12 is substantially the same as a gap G1 between the first stationary contact 15 and the first movable contact 16 (G=G1).

The main body 23 has a substantially uniform thickness along the longitudinal direction thereof and open ends, and can be contracted or elongated along the vertical direction. The main body 23 is located above the second stationary contact 17 and is separated therefrom by a space larger than the gap G1. The second movable contact 18 is formed on the lower surface of the main body 23. The upper surface of the main body 23 is adjacent to or in slight contact with the lower surface of the key 11.

The pair of left and right support portions 24 and 25 are constituted by elastic deformable plates. The upper ends of the support portions 24 and 25 are coupled to the central portions of the left and right sides of the main body 23, respectively. The lower ends of the support portions 24 and 25 are coupled to the upper surfaces of the free blocks 21*b* and 22*b*.

The first and second movable contacts 16 and 18 are made of conductive rubber and are manufactured together with the flexible member 20 by two-element simultaneous extrusion forming. Therefore, the first and second movable contacts 16 and 18 are formed extending the overall width of the flexible member 20, i.e., the overall width of the switch. Similarly, the stationary contacts 15 and 17 extend along the widthwise direction of the flexible member 20 so as to correspond to the movable contacts 16 and 18, respectively. In other words, the contact layout is designed to fall within the entire width of the flexible member 20.

The operation of the keyboard switch apparatus having the arrangement described above will be described hereinafter.

Figure 3A:
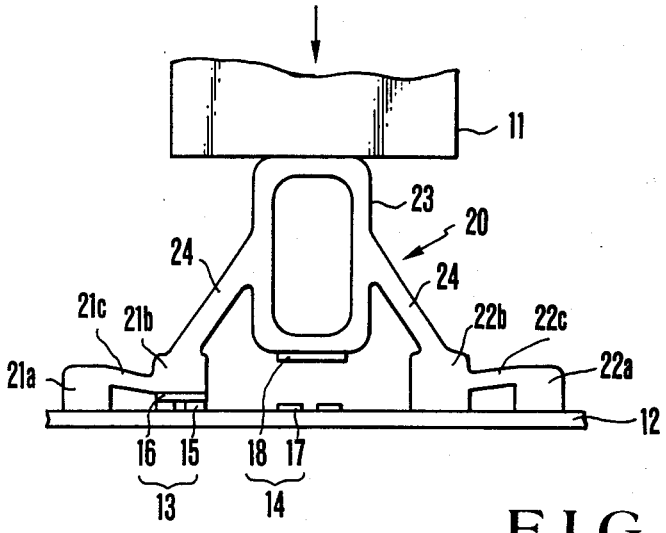
FIGS. 3A, 3B and 3C are front views of the keyboard switch apparatus of FIG. 1 for explaining its operation.

When a player depresses the key 11, it is pivoted about a pivot shaft at the rear end of the key at a speed determined by depression force. The main body 23 is urged downward by the key 11. The free end blocks 21*b* and 22*b* formed integrally with the main body 23 are elastically deformed and moved downward to bring the first movable contact 16 into contact with the first stationary contact 15, thereby closing the first switch 13 (FIG. 3A). At this point, the free end block 22*b* is in tight contact with the printed circuit board 12.

Figure 3B:
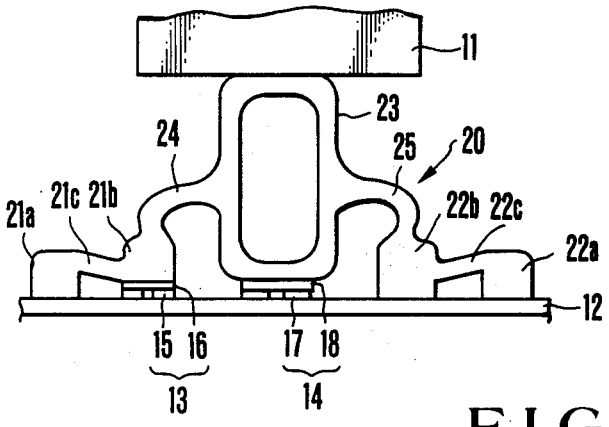
Figure 3C:
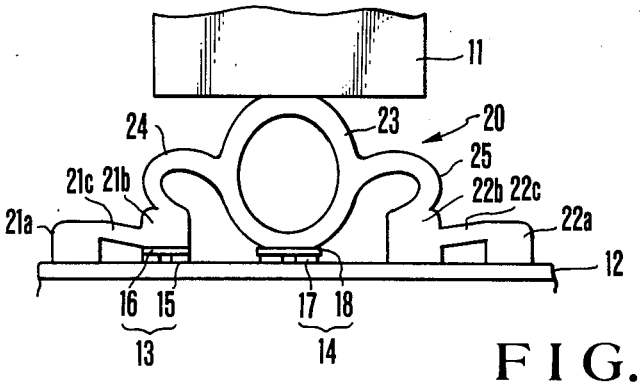

When the main body 23 is moved further downward, the support portions 24 and 25 are elastically deformed to bring the second movable contact 18 into contact with the second stationary contact 17, as shown in FIG. 3B, thereby closing the second switch 14. Upon further depression of the key 11, the second stationary contact 17 is brought into contact with the second movable contact 18 to deform the main body 23 itself, as shown in FIG. 3C.

The difference in turn-on timings of the first and second switches 13 and 14 upon depression of the key 11 varies according to the key depression speed. When the key 11 is depressed rapidly, the turn-on time difference of the first and second switches 13 and 14 is short. Otherwise, the turn-on time difference is long. When the difference between the turn-on times of the first and second switches 13 and 14 is detected by a time difference detector DET, a detection signal is supplied to a control circuit (not shown) so that the volume, envelope and tone color of the musical tone can be controlled. A known detector can be used as the detector DET, such as the one described in U.S. Pat. No. 4,301,704.

In this embodiment, the flexible member 20 is prepared by extrusion forming. The flexible member 20 can be more easily prepared than a conventional dome-like flexible member formed by injection molding. Even profiles which cannot be prepared by injection molding due to under-cut can be easily manufactured. Furthermore, since extrusion is used, the free end block 21*b* with the first movable contact 16 can have the same length as that of the main body 23 with the second movable contact 18. The size of the contact 16 can be equal to that of the contact 18, and hence the contact area between the first movable contact 16 and the first stationary contact 15 can be the same as that between the second movable contact 18 and the second stationary contact 17. Therefore, the switches 13 and 14 can be accurately operated and the overall switch apparatus can be made compact. Furthermore, since extrusion forming allows continuous and uniform manufacture of a profile, variations in dimensions of the products can be prevented and product quality can be improved.

Figure 4:
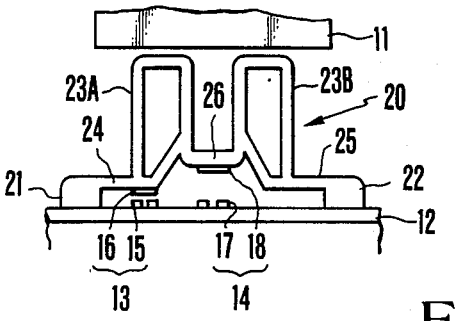
FIG. 4 is a front view of a keyboard switch apparatus according to another embodiment of the present invention.

FIG. 4 is a front view of a keyboard switch apparatus according to another embodiment of the present invention. The keyboard switch apparatus in FIG. 4 is substantially the same as that of FIGS. 1 and 2, except that a flexible member 20 has two elastically deformable main bodies 23A and 23B. A second movable contact 18 is formed on the lower surface of a connecting portion 26 connecting the two main bodies 23A and 23B located adjacent to legs 21 and 22 of an L-shaped cross section.

The embodiment of FIG. 4 is equally as effective as the embodiment of FIGS. 1 and 2.

Figure 5:
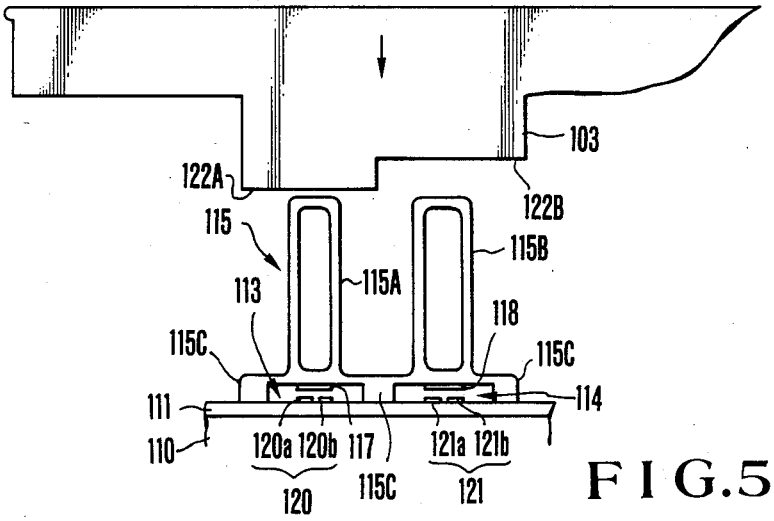
FIG. 5 is a front view of a keyboard switch apparatus according to still another embodiment of the present invention.
Figure 6:
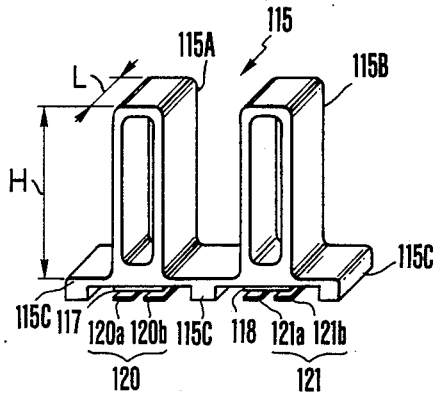
FIG. 6 is a perspective view of a flexible member shown in FIG. 5.

FIGS. 5 and 6 show a keyboard switch apparatus according to still another embodiment of the present invention. Referring to FIGS. 5 and 6, a printed circuit board 111 is mounted on a shelf board 110. First and second switches 113 and 114 which are sequentially closed upon depression of a key 103 are formed between the printed circuit board 111 and the key 103 through a flexible member 115.

The flexible member 115 is prepared by an extrusion forming method such that insulating rubber material is heated and melted, the melted insulating rubber is extruded by a pressure plate through an extrusion port of a die to obtain an elongated rod-like profile with a uniform cross-sectional shape along its longitudinal direction, and the profile is cut into pieces with a predetermined length L and height H. The flexible member 115 comprises a pair of left and right elastically deformable main bodies 115A and 115B and three legs 115C for elastically supporting the main bodies 115A and 115B. The main bodies 115A and 115B can be moved vertically by the legs 115C. The two legs 115C are connected to lower outer edges of the main bodies 115A and 115B, and the remaining one leg 115C is connected to the lower inner edges of the main bodies 115A and 115B. The main bodies 115A and 115B are open-ended and are constituted by hollow bodies which can be easily vertically deformed. First and second movable contacts 117 and 118 constituting the first and second switches 113 and 114 are formed on the lower surfaces of the main bodies 115A and 115B, respectively. First and second stationary contacts 120 and 121 are formed on the printed circuit board 111 at positions corresponding to the movable contacts 117 and 118. The first and second movable contacts 117 and 118 are made of conductive rubber and are formed together with the flexible member 115 by a two-element simultaneous extrusion forming method. Therefore, the movable contacts are formed extending across the overall width of the flexible member 115, i.e., the overall width of the switches. The first and second stationary contacts 120 and 121 are formed adjacent to each other on the printed circuit board 111, and comprise a pair of left and right conductive films **120*a* and 120*b* and a pair of left and right conductive films 121*a* and 121*b* adjacent to the first and second movable contacts 117 and 118. The layout of the first and second movable contacts 117 and 118 is designed to fall within the overall width of the flexible member 115**.

The legs 115C are fixed by an adhesive or the like to the upper surface of the printed circuit board 111. The gap between the first movable contact 117 and the corresponding stationary contacts is substantially the same as that between the second movable contact 118 and the corresponding stationary contacts.

The lower surface portion of the key 103 opposite the main body 115A of the flexible member 115 has a larger thickness than that opposite the main body 115B, thus constituting step surfaces 122A and 122B. The step surface 122A is normally close to (or in slight contact with) the upper surface of the main body 115A, and the step surface 122B is normally separated from the main body 115B.

Figure 7:
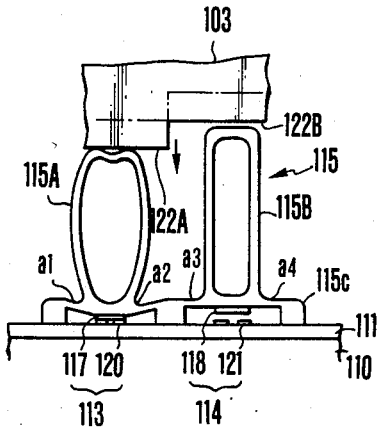
FIG. 7 is a front view of the keyboard switch apparatus of FIGS. 5 and 6 for explaining its operation.

When the player depresses the key 103, the step surface or projection 122A applies a pressure to the main body 115A, which is then elastically deformed, as shown in FIG. 7. The first movable contact 117 is brought into contact with the first stationary contact 120 to close the first switch 113. When the key 103 is further depressed, the step surface or projection 122B applies a pressure to the main body 115B which is then elastically deformed, thereby bringing the second movable contact 118 into contact with the second stationary contact 121 and closing the second switch 114. The turn-on time difference of the first and second switches 113 and 114 varies according to key depression speeds. When the key is depressed rapidly, the turn-on time difference is short. Otherwise, the turn-on time difference is long. The difference between the turn-on times of the switches 113 and 114 is detected, and a detection signal is supplied to a control circuit (not shown) so that the volume, envelope and tone color of the music can be controlled to correspond to a given key depression speed.

According to this embodiment, the flexible member 115 is prepared by extrusion forming, so that it is more easily manufactured than a conventional dome-like member formed by injection molding. In addition, complicated profiles which cannot be obtained by injection molding due to under-cut can easily be provided by extrusion forming. Furthermore, the length L can be arbitrarily set, and thus the movable contacts 117 and 118 can be both long and of the same length. The contact surface between the first movable contact 117 and the corresponding stationary contacts can be the same as that between the second movable contact 118 and the corresponding stationary contacts. As a result, the contact stability of the switches 113 and 114 can be improved and a compact switch apparatus can be obtained. Since extrusion forming allows continuous production of switches without dimensional variations, product quality is improved. Finally, the elastic deformation of the main bodies 115A and 115B is simpler than that of dome-like members, thus providing better key touch.

Figure 8:
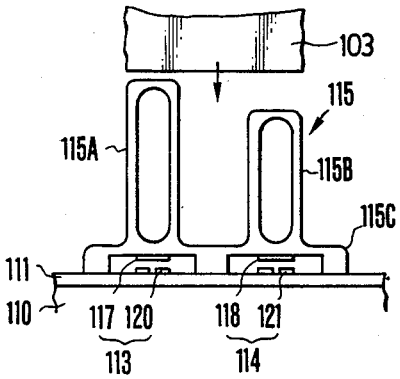
FIG. 8 is a front view of a keyboard switch apparatus according to still another embodiment of the present invention.

FIG. 8 shows a keyboard switch apparatus of still another embodiment which is similar to that of FIG. 5. Instead of forming the step surfaces on the lower surface of the key 103, a main body 115A for a first switch 113 is made taller than a main body 115B for a second switch 114. Other arrangements of this embodiment are the same as those of the embodiment in FIG. 5. The arrangement of FIG. 8 is equally as effective as the previous embodiments.

Figure 9:
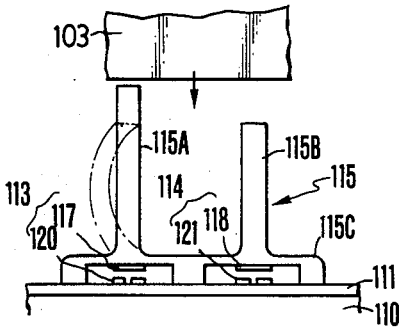
FIG. 9 is a front view of a keyboard switch apparatus according to still another embodiment of the present invention.

FIG. 9 is a front view of a keyboard switch apparatus according to still another embodiment of the present invention. In this embodiment, main bodies 115A and 115B of a flexible member 115 are constituted by elastically deformable solid plate members which have different heights, just as shown in FIG. 8.

In the above embodiments, the elastic force of support portions a1 to a4 (FIG. 7) of the legs 115C supporting the main bodies 115A and 115B is weaker than that of the main bodies 115A and 115B, so that the support portions a1 to a4 are deformed easier than the main bodies 115A and 115B when the latter are sequentially deformed. This can be achieved by decreasing the thickness of the support portions a1 to a4 or increasing their length.

Figure 10:
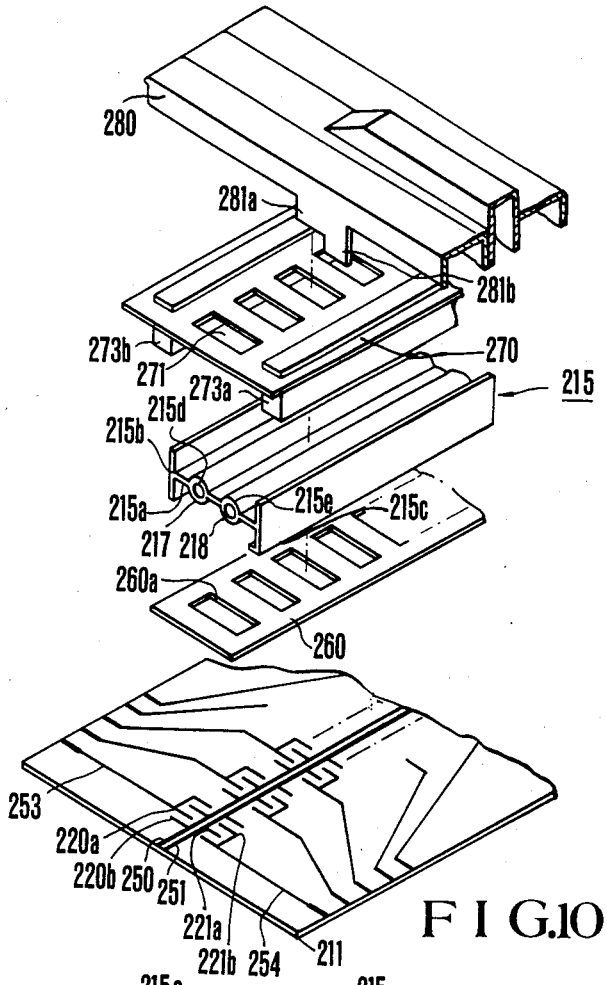
FIG. 10 is a developed view of a keyboard switch apparatus according to still another embodiment of the present invention.
Figure 11:
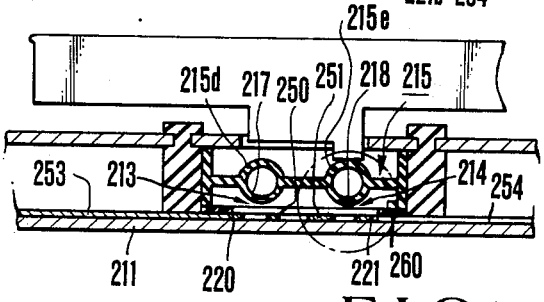
FIG. 11 is a sectional view of an assembly of the keyboard switch apparatus shown in FIG. 10.
Figure 11A:
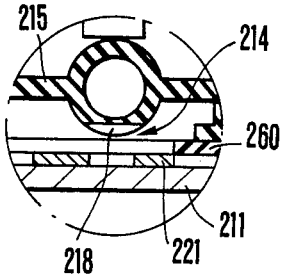
FIG. 11A is an enlarged sectional view showing the structure of a cylindrical portion and a movable contact formed integrally therewith in the assembly shown in FIG. 11.

FIGS. 10, 11 and 11A show a keyboard switch apparatus according to still another embodiment of the present invention. This embodiment is realized by developing the embodiment of FIG. 5. In the embodiment of FIGS. 10, 11 and 11A, adjacent key switch pairs for plural keys, each of which pairs is constituted by first and second switches 213 and 214, are grouped together to be included in a single keyboard switch apparatus.

Referring to FIGS. 10, 11 and 11A, first and second stationary contacts 220 and 221 constituting parts of said first and second key switches 213 and 214 are arranged on a printed circuit board or substrate 211 along a key array direction. The first and second stationary contacts 220 and 221 are constituted by a pair of interdigital conductive films 220*a* and 220*b* and a pair of interdigital conductive films 221*a* and 221*b* in units of key switches. The conductive films 220*b* and 221*a* are commonly connected respectively to the conductive films with the same function thereas in the adjacent keyboard switches, and are constituted by pairs of parallel films which respectively extend from common lines 250 and 251 in opposite directions (i.e., along the key array direction). The other conductive film 220*a* constituting the first stationary contact 220 is formed by two conductive films parallel to the conductive film 220*b* and constituting an interdigital arrangement. These two conductive films are connected together to a predetermined terminal on the printed circuit board 211 through a conductive film 253. The first stationary contact 220 is arranged independently for each key. The other conductive film 221*b* constituting the second stationary contact 221 is arranged for each key in the same manner as the conductive film 220*a* and is connected to a terminal on the circuit board 211 opposite to that for the conductive film 220*a* via a lead wire 254. A flexible member 215 with the first and second movable contacts is arranged on the printed circuit board so as to oppose the first and second stationary contacts 220 and 221 through an insulating rectangular spacer 260. The flexible member 215 is made of a flexible synthetic resin such as silicone rubber. The cross section of the flexible member 215 is substantially H-shaped. Support portions 215*b* and 215*c* are formed integrally with a central portion 215*a* at two ends thereof and extend along the key array direction. The support portions 215*b* and 215*c* are slightly tapered in the key array direction, and one 215*c* of them has an inward extension to distinguish the positioning direction of the member 215.

Parallel cylindrical portions 215*d* and 215*e* are formed at the central portion 215*a* of the flexible member 215 along the key array direction. First and second movable contacts 217 and 218, cooperating with the first and second stationary contacts, are formed integrally with the lower surfaces of the cylindrical portions 215*d* and 215*e*. The movable contacts 217 and 218 consist of carbon and silicone rubber. The movable contacts 217 and 218 are continuously formed at the lower surfaces of the cylindrical portions 215*d* and 215*e* along the longitudinal direction so as to be used commonly for the adjacent keys. The support portions 215*b* and 215*c*, formed at two ends of the central portion 215*a*, and the central portion 215*a*, including the movable contacts 217 and 218 and the cylindrical portions 215*d* and 215*e*, are simultaneously formed by a two-element extrusion forming method in the same manner as in the previous embodiments. The spacer 260 has proper holes 260*a* at key pitches so that the first and second movable contacts 217 and 218 can be brought into contact with the corresponding films 220*a*, 220*b*, 221*a* and 221*b*. As best illustrated in FIG. 11A, the movable contact 218 is integrally formed with the cylindrical portion 215*e* of the flexible member 215 to constitute an arcuated shape. In other words, the movable contact 218 has a chordal cross section. The lowermost portion of the movable contact 218 is spaced apart from the spacer 260. The same structure as described above is also employed for the integral structure of the cylindrical portion 215*d* and the movable contact 217.

The movable contacts are moved downward by stepped projections 281*a* and 281*b* of a key 280 which are moved downward upon depression of the key 280 through a hole 271 formed in a frame 270. The movable contacts 217 and 218 corresponding to the depressed key 280 are brought into contact with the corresponding stationary contacts 220 and 221, so that the electrical circuit of a detector is closed. Guides 273*a* and 273*b* are formed at the two side edges of the holes 271 in the frame 270 along the longitudinal direction. The guides 273*a* and 273*b* have a guide function for defining the mounting position of the flexible member 215. The guides 273*a* and 273*b* are mounted integrally with the frame 270 by a known outsert forming method. The reason why the support portions 215*b* and 215*c* are tapered is so that the flexible member 215 can be easily inserted between the guides 273*a* and 273*b*.

With the above arrangement, the projections 281*a* and 281*b* are moved downward upon depression of the key 280. Upon the downward movement of the projection 281*b* extending below the projection 281*a*, the second movable contact 218 is first brought into contact with the second stationary contact 221. Subsequently, after a time determined by the key depression speed, the first movable contact 217 is brought into contact with the first stationary contact 220 upon the downward movement of the projection 281*a*. A detector (not shown) detects the difference between the turn-on times of the two switches and generates a time difference signal.

With the above arrangement, the two movable contacts constituting the first and second switches are formed integrally with the flexible member. The contacts, the cylindrical portions, and the support portions of the flexible member 215 are simultaneously formed by an extrusion forming method, thus providing compact switches with uniform quality. The movable contacts are integrally formed with the single flexible member common to plural keys, the keyboard switch apparatus as a whole can be made compact, and the manufacturing process can be simplified.

The stationary contacts are printed on the printed circuit board. As described above, the movable contacts are formed integrally with the flexible member by extrusion forming, thereby obtaining a low-cost, compact keyboard switch apparatus with a small number of components in a simple manufacturing process.

By using the common key component to constitute switches, the keyboard switch apparatuses have uniform quality. When the keyboard switch apparatuses are manufactured in mass production lines, characteristics can be stabilized and check procedures can be simplified. In addition, the switches can be arranged in a high density. Since each movable contact is integrally combined with the flexible member, good key touch can be achieved.

Furthermore, with the above arrangement, the size of the movable and stationary contacts, i.e., the contact area can be easily set by changing the actuator dimension of the key above the movable contact because the movable contacts are continuous.

Comparing with the case that each switch is formed as a single discrete device, the lateral space factor is improved since each contact is formed throughout the width of the key.

The present invention is not limited to the particular embodiments described above. Various changes and modifications may be made within the spirit and scope of the invention.

What is claimed is:

1. A keyboard switch apparatus for an electronic musical instrument, said musical instrument having a keyboard with a plurality of keys arranged side by side in a predetermined direction, said switch apparatus comprising, for each key of said keyboard, a plurality of switches each constituted by stationary and movable contacts, said stationary contacts of said switches being formed adjacent to each other on a substrate, said movable contacts of said switches being mounted on a single flexible member arranged above said substrate and being normally spaced apart from said stationary contacts at positions opposite thereto, said key being arranged adjacent to said flexible member, said flexible member and said movable contacts of said switches forming an integrated structureal element having a uniform cross-sectional shape along the direction in which the keys of said keyboard are arranged, said flexible member being deformed by depression of said key, such that, as said key is depressed said switches are closed sequentially, the time interval between the closure of consecutive switches depending on the speed at which said key is depressed.

2. An apparatus according to claim 1, wherein said stationary contacts are each constituted by a plurality of segments of a conductive film formed on the surface of said substrate.

3. An apparatus according to claim 1, wherein each key has a projection with a predetermined number of stepped surfaces opposite said switches, the number of said stepped surfaces being equal to the number of said switches, said stepped surfaces each having a different level, each stepped surface being located opposit one of said switches so as to close said switches sequentially.

4. An apparatus according to claim 1, wherein said flexible member comprises a central portion with integrally formed cylindrical portions, the first of said cylindrical portions containing said movable contact of one of said plurality of switches, the second cylindrical portion containing said movable contact of another of said plurality of switches second switch, said movable contacts opposite to said stationary contacts of said plurality of switches, and support portions integrally formed with both ends of said central portion, said cylindrical portions and said support portions being extended along a widthwise direction of said key.

5. An apparatus according to claim 4, wherein a spacer is arranged between said flexible member and said substrate so as to keep said movable contacts apart from said stationary contacts when the key is in an undepressed position.

6. An apparatus according to claim 1, wherein a single length of flexible material having said uniform cross-sectional shape forms the said flexible member containing said movable contacts of a plurality of adjacent keys.

7. A keyboard switch apparatus for an electronic musical instrument, said musical instrument having a keyboard with a plurality of keys arranged side by side in a predetermined direction, said switch apparatus comprising, for each key of said keyboard, first and second switches each constituted by stationary and movable contacts, said stationary contacts of said first and second switches being formed adjacent to each other on a substrate, said movable contacts of said first and second switches being mounted on a single flexible member arranged above said substrate and being normally spaced apart from said stationary contacts of said first and second switches at positions opposite thereto, said key being arranged adjacent to said flexible member, said flexible means and said movable contacts of said first and second switches forming an integrated structural element having a uniform cross-sectional shape along the direction in which the keys of said keyboard are arranged, said flexible member comprising two legs of an L-shaped cross section and a main body located between said two legs, and support portions for connecting said two legs and said main body, said movable contact of said first switch being formed on a flat portion of a corresponding one of said legs at a position opposite corresponding ones of said stationary contacts, said movable contact of said second switch being located at a position opposite the corresponding one of said stationary contacts on said main body, a distance between said movable and stationary contacts of said first switch being different from that between said movable and stationary contacts of said second switch, said flexible member being deformed by depression of said key, such that, as said key is depressed, said first and second switches are closed sequentially, the time interval between the closure of said first and second switches depending on the speed at which said key is depressed.

8. An apparatus according to claim 7, wherein said movable contacts are arranged between two side ends of the key so as to be operated by the same one key.

9. An apparatus according to claim 7, wherein said main body of said flexible member comprises deformable portions which are located at positions corresponding to the positions of said first and second switches.

10. A keyboard switch apparatus for an electronic musical instrument, said musical instrument having a keyboard with a plurality of keys arranged side by side in a predetermined direction, said switch apparatus comprising, for each key of said keyboard, first and second switches each constituted by stationary and movable contacts, said stationary contacts of said first and second switches being formed adjacent to each other on a substrate, said movable contacts of said first and second switches being mounted on a single flexible member arranged above said substrate and being normally spaced apart from said stationary contacts of said first and second switches at positions opposite thereto, said key being arranged adjacent to said flexible member, said flexible member and said movable contact of said first and second switches forming an integrated structural element having a uniform cross-sectional shape along the direction in which the keys of said keyboard are arranged, said flexible member comprising two legs of an L-shaped cross section, two elastically deformable main bodies located between said two legs and a connecting portion for connecting said main bodies, said movable contact of said first switch being located at a position opposite corresponding ones of said stationary contacts formed on a flat portion of a corresponding one of said two legs, said movable contact of said second switch being formed on said connecting portion at a position opposite corresponding one of said stationary contacts, a distance between said movable and stationary contacts of said first switch being different from that between said movable and stationary contacts of said second switch, said flexible member being deformed by depression of said key, such that, as said key is depressed, said first and second switches are closed sequentially, the time interval between the closure of said first and second switches depending on the speed at which said key is depressed.

11. A keyboard switch apparatus for an electronic musical instrument, said musical instrument having a keyboard with a plurality of keys arranged side by side in a predetermined direction, said switch apparatus comprising, for each key of said keyboard, first and second switches each constituted by stationary and movable contacts, said stationary contacts of said first and second switches being formed adjacent to each other on a substrate, said movable contacts of said first and second switches being mounted on a single flexible member arranged above said substrate and being normally spaced apart from said stationary contacts of said first and second switches at positions opposite thereto, said key being arranged adjacent to said flexible member, said flexible member and said movable contact of said first and second switches forming an integrated structural element having a uniform cross-sectional shape along the direction in which the keys of said keyboard are arranged, each of said keys having a projection with stepped surfaces opposite said first and second switches, said flexible member comprising two legs and two main bodies located therebetween, said main bodies being located at positions corresponding to said stepped surfaces of said projections, said first and second movable contacts being formed on lower surfaces of said main bodies, a distance between said movable and stationary contacts of said first switch being substantially the same as that between said movable and stationary contacts of said second switch said flexible member being deformed by depression of said key, such that, as said key is depressed, said first and second switches are closed sequentially, the time interval between the closure of said first and second switches depending on the speed at which said key is depressed.

12. A keyboard switch apparatus for an electronic musical instrument, said musical instrument having a keyboard with a plurality of keys arranged side by side in a predetermined direction, said switch apparatus comprising, for each key of said keyboard, first and second switches each constituted by stationary and movable contacts, said stationary contacts of said first and second switches being formed adjacent to each other on a substrate, said movable contacts of said first and second switches being mounted on a single flexible member arranged above said substrate and being normally spaced apart from said stationary contacts of said first and second switches at positions opposite thereto, said key being arranged adjacent to said flexible member, said flexible member and said movable contact of said first and second switches forming an integrated structural element having a uniform cross-sectional shape along the direction in which the keys of said keyboard are arranged, said flexible member comprising two legs and two main bodies located therebetween, said main bodies being elastically deformable, said first and second movable contacts being formed on lower surface os said main bodies, said main bodies being located at positions corresponding to said stationary contacts of said first and second switches, a distance between said movable and stationary contacts of said first switch being substantially the same as that between said movable and stationary contacts of said second switch, the main bodies having different heights or shapes, said flexible member being deformed by depression of said key, such that, as said key is depressed, said first and second switches are closed sequentially, the time interval between the closure of said first and second switches depending on the second at which said key is depressed.

13. A keyboard switch apparatus for an electronic musical instrument, said musical instrument having a keyboard with a plurality of keys arranged side by side in a predetermined direction, said switch apparatus comprising, for each key of said keyboard, first and second switches each constituted by stationary and movable contacts, said stationary contacts of said first and second switches being formed adjacent to each other on a substrate, said movable contacts of said first and second switches being mounted on a single flexible member arranged above said substrate and being normally spaced apart from said stationary contacts of said first and second switches at positions opposite thereto, said key being arranged adjacent to said flexible member, said flexible member and said movable contacts of said first and second switches forming an integrated structural element having a uniform cross-sectional shape along the direction in which the keys of said keyboard are arranged, said flexible member being deformed by depression of said key, such that, as said key is depressed, said first and second switches are closed sequentially, the time interval between the closure of said first and second switches depending on the speed at which said key is depressed, said flexible member of a number of adjacent keys being comprised of a single length of extruded flexible material, said movable contacts of said first switches and said movable contacts of said second switches of said adjacent keys each being made of a single strip of conductive material, said strips of conductive material being integrally formed with the flexible member by using a two-element extrusion process, said conductive material being a conductive plastic or other material that is capable of being extrusion formed, such that a single extruded piece forms the flexible members, the movable contacts for the first switches, and the movable contacts for the second switches for said adjacent keys.

14. A keyboard switch apparatus for an electronic musical instrument, said musical instrument having a keyboard with a plurality of keys arranged side by side in a predetermined direction, said switch apparatus comprising, for each key of said keyboard, first and second switches each constituted by stationary and movable contacts, said stationary contacts of said first and second switches being formed adjacent to each other on a substrate, said movable contacts of said first and second switches being mounted on a single flexible member arranged above said substrate and being normally spaced apart from said stationary contacts of said first and second switches at positions opposite thereto, said key being arranged adjacent to said flexible member, said flexible member and said movable contact of said first and second switches forming an integrated structural element having a uniform cross-sectional shape along the direction in which the keys of said keyboard are arranged, said flexible member comprising two legs and two main bodies located therebetween, said main bodies being elastically deformable, said first and second movable contacts being formed on lower surfaces of said main bodies, said main bodies being located at positions corresponding to said stationary contacts of said first and second switches, a distance between said movable and stationary contacts of said first switch being substantially the same as that between said movable and stationary contacts of said second switch, the main bodies having different heights or shapes, said flexible member being deformed by depression of said key, such that, as said key is depressed, said first and second switches are closed sequentially, the time interval between the closure of said first and second switches depending on the speed at which said key is depressed, said main bodies being hollow.

* * * * *